US005823339A

United States Patent [19]

Dunham et al.

[11] Patent Number: 5,823,339

[45] Date of Patent: Oct. 20, 1998

[54] PACKAGING CONTAINER FOR A STRING TRIMMER

[75] Inventors: David A. Dunham, Baltimore, Md.; Robert G. Haskett, Lowell, N.C.; Paul Dennis Owings; Henry Louis Tew, both of Fayetteville, N.C.; Jeffrey B. Davis, Potomac, Md.; Christopher E. Jacob, Baltimore, Md.; Maureen Wolthuis, Towson, Md.

[73] Assignee: Black & Decker Inc., Newark, Del.

[21] Appl. No.: 686,901

[22] Filed: Jul. 25, 1996

[51] Int. Cl.[6] ..... B65D 5/50; B65D 71/08

[52] U.S. Cl. ..... 206/349; 206/781; 206/782

[58] Field of Search ..... 206/349, 576, 206/775, 781, 782, 783, 784; 53/452, 461, 462, 476

[56] References Cited

U.S. PATENT DOCUMENTS

| | | | |
|---|---|---|---|
| 1,932,705 | 10/1933 | Menten . | |
| 2,290,104 | 7/1942 | Lasson | 206/781 X |
| 2,670,126 | 2/1954 | Frankenstein . | |
| 2,727,620 | 12/1955 | Buttery . | |
| 2,983,368 | 5/1961 | Vander Lugt, Jr. . | |
| 3,158,259 | 11/1964 | Pantalone . | |
| 3,282,410 | 11/1966 | Cote . | |
| 3,481,453 | 12/1969 | Shreve, III et al. . | |
| 3,517,801 | 6/1970 | Cote . | |
| 3,669,253 | 6/1972 | Hanko . | |
| 3,750,870 | 8/1973 | Cote . | |
| 3,765,529 | 10/1973 | Mueller . | |
| 3,767,037 | 10/1973 | Anderson | 206/781 |
| 3,896,927 | 7/1975 | Dutcher . | |
| 3,896,928 | 7/1975 | Forté . | |
| 3,987,893 | 10/1976 | Hanson . | |
| 4,099,612 | 7/1978 | Hanson . | |
| 4,126,220 | 11/1978 | Roccaforte | 206/783 X |
| 4,171,050 | 10/1979 | Murray et al. . | |
| 4,285,432 | 8/1981 | de Villers et al. . | |
| 4,385,687 | 5/1983 | Dutcher . | |
| 4,397,393 | 8/1983 | Pergande et al. . | |
| 4,429,791 | 2/1984 | Ruppel et al. | 206/782 X |
| 4,607,750 | 8/1986 | Valenti . | |
| 4,662,512 | 5/1987 | Durand . | |
| 4,779,726 | 10/1988 | Pratt . | |
| 5,048,677 | 9/1991 | Pedracine . | |
| 5,156,276 | 10/1992 | Lebowitz . | |
| 5,172,806 | 12/1992 | Mickelberg . | |
| 5,289,916 | 3/1994 | Mickelberg . | |
| 5,332,085 | 7/1994 | Fraser . | |
| 5,348,145 | 9/1994 | Steinfels, III . | |
| 5,428,940 | 7/1995 | Paumen et al. . | |
| 5,485,913 | 1/1996 | Steinfels, III . | |
| 5,495,937 | 3/1996 | Fraser . | |

FOREIGN PATENT DOCUMENTS

| | | |
|---|---|---|
| 2263167 | 10/1975 | France . |
| 2228312 | 1/1973 | Germany . |
| 615490 | 1/1949 | United Kingdom . |
| 1174044 | 12/1969 | United Kingdom . |
| 1192582 | 5/1970 | United Kingdom . |

*Primary Examiner*—Jacob K. Ackun
*Attorney, Agent, or Firm*—Harness, Dickey & Pierce P.L.C.

[57] ABSTRACT

A container has a back wall, a pair of opposing side walls extending from the back wall, and a front wall extending between the side walls to define a rectangular sleeve. Apertures are formed in the front wall to enable access within the sleeve. The apertures are separated from one another by a front wall portion. Also, a top and bottom band are formed at the ends of the container. At least one positioning member extends from the front wall. The positioning member extends toward the back wall to maintain an article in position within the container.

23 Claims, 2 Drawing Sheets

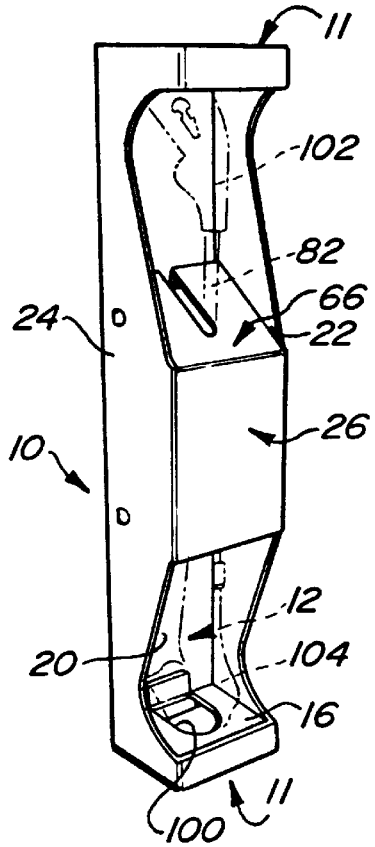
Fig-1
Fig-2
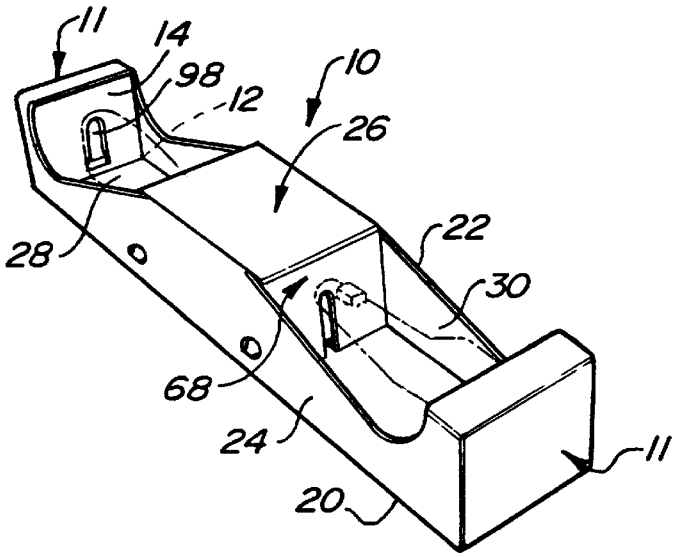
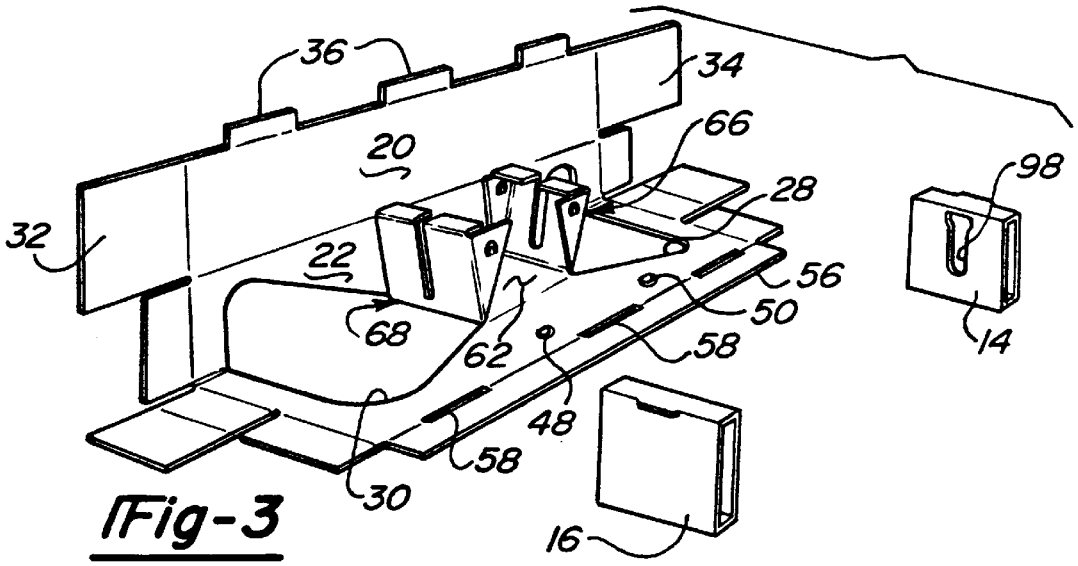
Fig-3

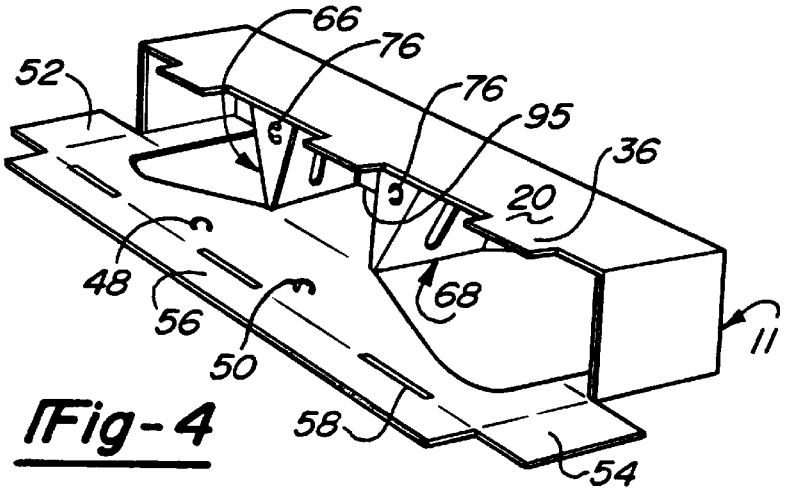
Fig-4
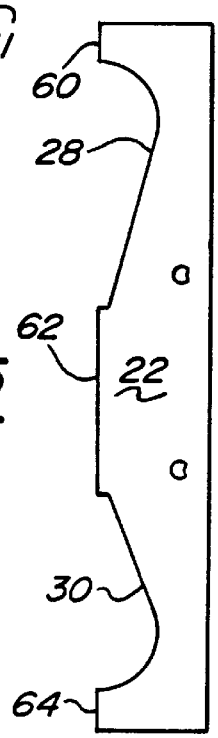
Fig-5
Fig-6
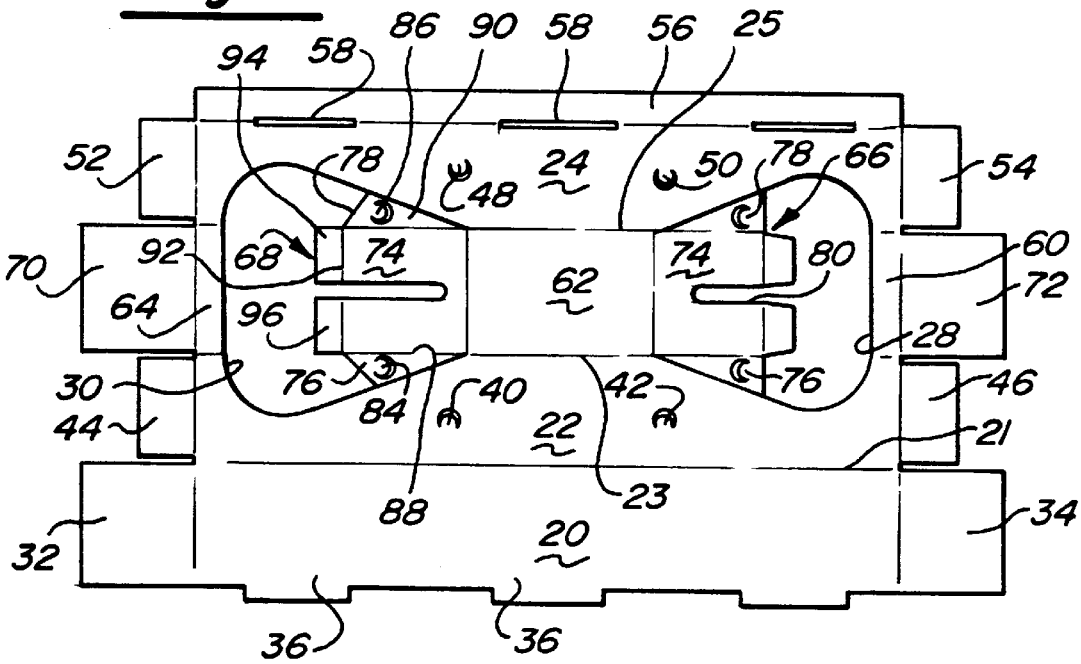

PACKAGING CONTAINER FOR A STRING TRIMMER

BACKGROUND OF THE INVENTION

The present invention relates to packaging containers or boxes. More particularly, the present invention relates to a shipping and display box for outdoor lawn implements such as string trimmers.

In the consumer market, it is desirable to have aesthetic packaging. However, along with being aesthetically pleasing, the packaging should be durable for shipping purposes. Also it is desirable to position the product within its package so that it can be easily manipulated while the product remains positioned within the package. Thus, the ultimate consumer packaging would be sturdy; enable easy shipment; draw the consumer to the package; enable the consumer to manipulate the product; and maintain the position of the product in the package in an aesthetic arrangement.

SUMMARY OF THE INVENTION

Accordingly, it is an object of the present invention to provide an improved packaging container and display box which embodies the above criteria.

In accordance with one aspect of the invention, a container comprises a back wall, a pair of opposing side walls extending from the back wall, and a front wall extending between the side walls to form a rectangular sleeve. The front wall includes a pair of apertures which enable access within the sleeve. The apertures are separated from one another by the front wall. Also, continuous top and bottom bands are formed at the ends of the container sleeve. At least one positioning member extends from the front wall. The positioning member extends toward the back wall to maintain an article within the container sleeve. The container may be of a one-piece construction, however, preferably inserts are positioned into the top and bottom bands to retain the article in the container. A pair of positioning members may also maintain the article in the container. The apertures are preferably formed in both the front and the side walls. The portion cut from the front and side walls, which forms the apertures, forms the positioning members. The positioning members include a cut-out to receive the article which is to be held within the container. The positioning members include a first portion extending toward the rear wall and a pair of side portions which are adjacent the side walls. The side walls, as well as the side portions, include aligned cut-out tabs which cooperate with one another to secure the positioning member with the side walls. A storage compartment is formed in the sleeve between the front, back and side walls with the positioning members closing the ends of the storage compartment.

In accordance with a second aspect of the invention, a string trimmer container comprises a one-piece construction which includes a back wall, a pair of opposing side walls, and a partial front wall between the side walls to form a rectangular sleeve. The front wall includes a top, middle and bottom portion which are continuous with the side walls forming the rectangular sleeve. Openings are formed between the top and middle and middle and bottom portions of the front walls. At least one positioning member extends from the middle portion of the front wall toward the back wall into the rectangular sleeve. The positioning member positions the string trimmer in the container. Inserts are positioned in the top and bottom portions of the sleeve to retain the article in the container. A pair of positioning members may also maintain the article in the container. The openings are preferably formed in both the front and the side walls. The portion cut from the front and side walls, forming the openings, forms the positioning members. Each positioning member includes a cut-out to receive the article which is to be held within the container. Each positioning member includes a first portion extending toward the rear wall and a pair of side portions which are adjacent the side walls. The side walls, as well as the side portions, include aligned cut-out tabs which cooperate with one another to secure the positioning member with the side walls.

In accordance with the third aspect of the invention, a method of forming a string trimmer package comprises providing a blank including four rectangular panels. Each panel includes end flaps and apertures are formed in at least one panel. The apertures divide the panel into three portions, a top, middle and bottom. At least one positioning member is formed with the middle portion. The positioning member is folded away from the middle portion to receive an elongated portion of the string trimmer. The four panels are folded into a rectangular sleeve surrounding the string trimmer. The panels are secured together. Also, the end flaps are folded to close the ends of the package and the flaps are secured to one another. The method also includes positioning inserts at the top and bottom of the sleeve to retain the string trimmer in position within the package. The positioning members are locked with the side walls to secure them in position. Also, a second positioning member is included which along with the first positioning member, the middle portion, side and back panels, forms a closed storage area within the sleeve.

Additional objects and advantages of the invention will be apparent from the detailed description of the preferred embodiment, and the appended claims and accompanying drawings, or may be learned by practice of the invention.

BRIEF DESCRIPTION OF THE DRAWINGS

The accompanying drawings, which are incorporated in and constitute a part of the specification, illustrate one embodiment of the present invention and together, with the description, serve to explain the principles of the invention. In the drawings, the same reference numerals indicate the same parts.

FIG. 1 is a perspective view of a container in accordance with the present invention with a string trimmer in phantom.

FIG. 2 is an exploded perspective view of the container of FIG. 1 with the back wall in an open position.

FIG. 3 is a perspective view of the container of FIG. 1 in a partially folded condition.

FIG. 4 is a bottom perspective view of the container of FIG. 1.

FIG. 5 is a side plan view of the container of FIG. 1.

FIG. 6 is a plan view of the blank of the container of FIG. 1.

DETAILED DESCRIPTION OF THE PREFERRED EMBODIMENT

The preferred embodiment of the present invention is a packaging container for an outdoor lawn implement such as a string trimmer.

Turning to the figures, a container for a string trimmer is illustrated and designated with the reference numeral 10. The container 10 is illustrated with a string trimmer 12, illustrated in phantom. The container 10 is formed from a blank of paper board material as a one-piece construction with inserts 14 and 16 retaining the ends of the trimmer in position within the container 16.

The container 10 includes a back wall or panel 20, opposing side walls or panels 22 and 24, and a front wall or panel 26 divided by a pair of apertures 28, 30. The back wall 20 has an overall rectangular shape with end flaps 32 and 34 at its longitudinal ends. A series of tabs 36 are on one longitudinal side of the back wall 20. The tabs 36 are friction fit into slits 58, between the side wall 24 and its tongue 56. The connection frictionally holds the container in a rectangular sleeve assembled position.

The side wall 22 has an overall rectangular shape with a portion of the apertures 28, 30 cut into the side wall 22. Tabs 40 and 42 are cut into the side wall 22. The tabs 40, 42 enable securement of positioning members as will be discussed herein. The side wall 22 is continuous with the back wall 20. However, they are separated by a fold line 21. Also, the side wall 22 includes end flaps 44 and 46 at its longitudinal ends. The end flaps close the ends 11 of the container 10.

The other side wall 24 is substantially similar to the side wall 22 including cut-out tabs 48, 50, portion of the apertures 28, 30, as well as end flaps 52, 54. The side wall 24 includes a tongue 56 along one of its longitudinal sides. Slits 58 are formed on the fold line 29 between the tongue 56 and side wall 24. The slits 58 enable insertion of the tabs 36 to frictionally hold the container in its rectangular sleeve position as seen in FIG. 1.

The front wall 26 includes three portions, a top 60, middle 62 and bottom 64. All three portions are continuous with the side walls 22, 24 along fold lines 23 and 25. Positioning members 66 and 68 extend from the middle portion 62. While one positioning member may be used, two are illustrated and preferred. The positioning members 66 and 68 are cut out of the side walls 22, 24 and front walls 26 to define the apertures 28, 30. The apertures 28, 30 enable access to the string trimmer so that the consumer may manipulate and "get the feel" of the string trimmer prior to purchasing, while the string trimmer is still within the package 10. The front wall 26 includes end flaps 70, 72 to enable closing of the ends 11 of the container 10.

The positioning members 66, 68 include a first rectangular portion 74, formed from the front wall, and a pair of triangular side portions 76, 78, formed from the side walls 22, 24. The first rectangular portion 74 includes a slot 80 which fits around the elongated bar 82 of the string trimmer 12. The side portions 76, 78 include a cut-out tab 84, 86 which aligns with the cut-out tabs 40, 42 of the side walls 22, 24 to enable the tabs 40, 42, 84, 86 to be pushed inward to secure the positioning members 66, 68 with the side walls 22, 24 locking the positioning members 66, 68 in position within the rectangular sleeve. As can be seen in FIG. 6, the first rectangular portion 74 includes score lines 88, 90 cut along its sides to enable forming of the triangular side portions 76, 78. Also, the first portion 74 is laterally scored by score line 92 to form tabs 94, 96 which are folded under the first rectangular portion 74, when the first rectangular portion 74, is moved toward the rear wall 20, to further stabilize the positioning members 66, 68.

A storage area 95 is formed in the rectangular sleeve between side walls 22, 24 and back 20 and front middle wall 60. The ends of the storage area 95 are closed by the positioning members 66 and 68. The storage area 95 enables auxiliary attachments within the container 10 while not distracting from the aesthetic appearance of the container 10.

The inserts 14, 16 include apertures 98, 100 to receive the handle 102 and cutting head 104 of the string trimmer 12. The inserts 14, 16 are folded members which are positioned into the top and bottom of the container ends 11.

The string trimmer 12 is ordinarily packaged and the container formed as follows. The inserts 14, 16 are positioned on the cutting head 104 and handle 102 of the string trimmer 12. The blank, with apertures therein, is positioned in an opened flat position. The positioning members 66, 68 are folded out of the front panel 26 and the elongated bar 82 of the string trimmer 12 is positioned within the slots 80 of the positioning members 66, 68. Also, side panel 24 is folded along fold line 25 with respect to the front panel 26. The tongue 56 of side panel 24 is folded along fold line 29 inward while the other side panel 22 and back panel 20 are folded along fold lines 21, 23 around the string trimmer 12. The tabs 36 of the back panel 20 are inserted into the slits 58 of the side panel 24 to secure the container in its rectangular sleeve position. The flaps 44, 46, 52, 54, 32, 34, 70, 72 are folded to close the ends 11 of the container and the flaps can either be glued or taped together in a conventional manner. Also, parts which are included with the string trimmer, such as a guard, secondary handle, spool or the like, may be positioned in the closed rectangular sleeve area defined by the back 20, side 22, 24 and middle 62 front panels and the positioning member 66, 68. Thus, instructions, guards and the like can be housed within the container while not distracting from the aesthetic appearance of the container.

While the above detailed description describes the preferred embodiment of the present invention, the invention is susceptible to modification, variation, and alteration without deviating from the scope and fair meaning of the subjoined claims.

We claim:

1. A container comprising:

a back wall, a pair of opposing side walls extending from said back wall and a front wall extending between said side wall defining a rectangular sleeve, said front wall including a pair of apertures enabling access within said sleeve, said apertures separated from one another by said front wall and forming a top and bottom band at ends of the container;

at least one positioning member extending from said front wall, said positioning member extending toward said back wall and for maintaining an article within said container.

2. The container according to claim 1, wherein the container is formed from a one-piece blank.

3. The container according to claim 1, wherein an insert is positioned at the top and bottom bands to retain the article in said container.

4. The container according to claim 1, wherein a pair of positioning members maintain the article in said rectangular sleeve.

5. The container according to claim 4, wherein said apertures are formed in said front wall and said side walls.

6. The container according to claim 5, wherein the portion cut from said front and side walls forms said positioning members.

7. The container according to claim 6, wherein said positioning members include a slot to receive said article.

8. The container according to claim 7, wherein said positioning members include a first portion extending toward said rear wall and a pair of side portions adjacent said side walls.

9. The container according to claim 8, wherein said side walls and side portions include aligned cut-out tabs which cooperate with one another to secure the positioning member with the side walls.

10. The container according to claim 9, wherein said back wall, side walls, front wall and positioning members form a storage space for positioning of auxiliary parts.

11. A string trimmer container comprising:

a one-piece construction including a back wall, a pair of opposing side walls and a front wall extending between said side walls defining a rectangular sleeve, said front wall including a top, middle and bottom portion, said top, middle and bottom portions continuous with said side walls, and openings formed between said top and middle and middle and bottom portions, said openings enabling access to the string trimmer;

at least one positioning member extending from said middle portion toward said back wall into said rectangular sleeve, said positioning member maintaining the string trimmer within the container.

12. The string trimmer container according to claim 11, wherein an insert is positioned at the top and bottom portions to retain the article in said container.

13. The string trimmer container according to claim 11, wherein a pair of positioning members maintain the article in said container.

14. The string trimmer container according to claim 11, wherein said openings are formed in said front wall and said side walls.

15. The string trimmer container according to claim 14, wherein the portion cut from said front and side walls forms said positioning member.

16. The string trimmer container according to claim 15, wherein said positioning member includes a slot to receive an elongated portion of the string trimmer.

17. The string trimmer container according to claim 16, wherein said positioning member includes a portion extending toward said rear wall and a pair of side portions adjacent said side walls.

18. The string trimmer container according to claim 17, wherein said side walls and side portions include aligned cut-out tabs which cooperate with one another to secure the positioning member with the side walls.

19. The string trimmer container according to claim 18, wherein an insert is positioned at the top and bottom portions to retain the article in said container.

20. A method of forming a string trimmer package comprising:

providing a blank including four rectangular panels, each panel including end flaps, apertures formed in at least one panel dividing said panel into three portions, a top, middle and bottom, at least one positioning member formed with said middle portion;

folding said positioning member away from said middle portion to receive an elongated portion of said string trimmer;

folding said four panels into a rectangular sleeve;

securing said four panels together;

folding said flaps to close the end of the package; and securing said flaps together.

21. The method according to claim 20, further comprising positioning inserts at the top and bottom of the sleeve to retain the string trimmer in position on the package.

22. The method according to claim 20, further comprising locking the positioning member with the side walls.

23. The method according to claim 20, further comprising a second positioning member and forming a closed storage area within said sleeve.

* * * * *